United States Patent [19]

Ransom

[11] 3,938,126

[45] Feb. 10, 1976

[54] HANDBAG ALARM SYSTEM

[75] Inventor: Mary Ransom, New York, N.Y.

[73] Assignee: The Raymond Lee Organization, Inc., New York, N.Y. ; a part interest

[22] Filed: Nov. 7, 1974

[21] Appl. No.: 521,676

[52] U.S. Cl. ..... 340/280; 340/256; 340/283

[51] Int. Cl.[2] ..... G08B 13/08; G08B 13/12

[58] Field of Search ..... 340/280, 283, 256

[56] References Cited

UNITED STATES PATENTS

| | | | |
|---|---|---|---|
| 1,582,745 | 4/1926 | Geffcken et al. | 340/256 |
| 3,426,217 | 2/1969 | Womble, Jr. | 340/256 |
| 3,742,480 | 6/1973 | Hoecker | 340/280 |
| 3,851,326 | 11/1974 | Costa | 340/280 |

*Primary Examiner*—Glen R. Swann, III

*Attorney, Agent, or Firm*—Daniel Jay Tick

[57] ABSTRACT

A battery in a handbag is electrically connected to an audible alarm in the handbag for energizing the alarm to produce an audible signal. A short-circuiting electrical conductor is electrically connected in shunt across the battery and extends through the handle and closing device of the handbag. The short-circuiting conductor short-circuits the battery and prevents energizing of the alarm. When the short-circuiting conductor is opened anywhere along its length it fails to short-circuit the alarm and the alarm is energized.

3 Claims, 3 Drawing Figures

HANDBAG ALARM SYSTEM

BACKGROUND OF THE INVENTION

The present invention relates to a handbag alarm system.

Objects of the invention are to provide a handbag alarm device of simple structure, which is inexpensive in manufacture, installable with facility and convenience in new and existing handbags, and functions efficiently, effectively and reliably to produce an audible alarm when the handbag is opened, the handle thereof is cut or a change purse therein is severed therefrom.

BRIEF DESCRIPTION OF THE DRAWING

In order that the invention may be readily carried into effect, it will now be described with reference to the accompanying drawing, wherein.

DETAILED DESCRIPTION OF THE INVENTION

Figure 1:
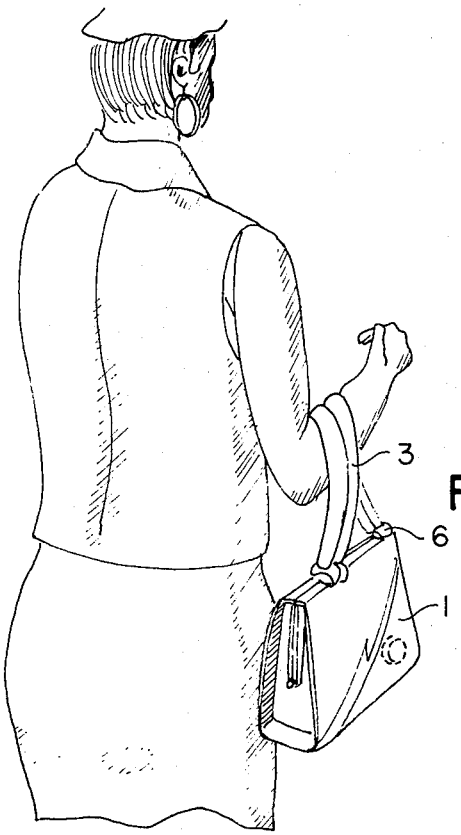
FIG. 1 is a schematic diagram of a handbag of the type utilizing the handbag alarm system of the invention.
Figure 2:
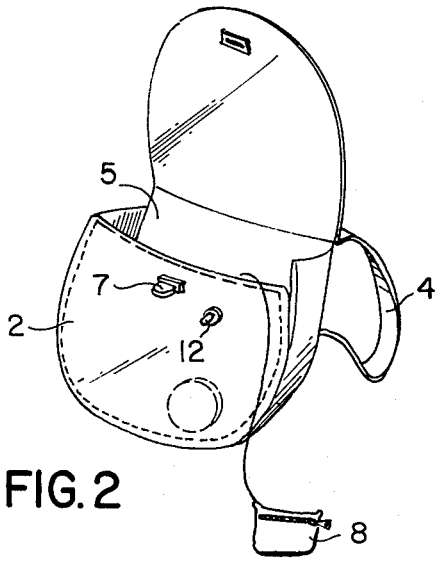
FIG. 2 is a schematic diagram of another handbag utilizing the handbag alarm system of the invention.

The handbag alarm system of the invention is for a handbag 1 (FIG. 1) or 2 (FIG. 2) having a handle 3 (FIG. 1) or 4 (FIG. 2), an opening 5 (FIG. 2), a closing device 6 (FIG. 1) or 7 (FIG. 2) for selectively closing the opening, and a change purse 8 (FIGS. 2 and 3) stored in the handbag.

The handbag alarm system of the invention comprises an audible alarm 9 (FIG. 3) in the handbag. A battery 10 (FIG. 3) in the handbag is electrically connected to the alarm 9 for energizing the alarm to produce an audible signal. Each of the alarm 9 and the battery 10 comprises any suitable known audible alarm and battery or batteries, respectively.

Figure 3:
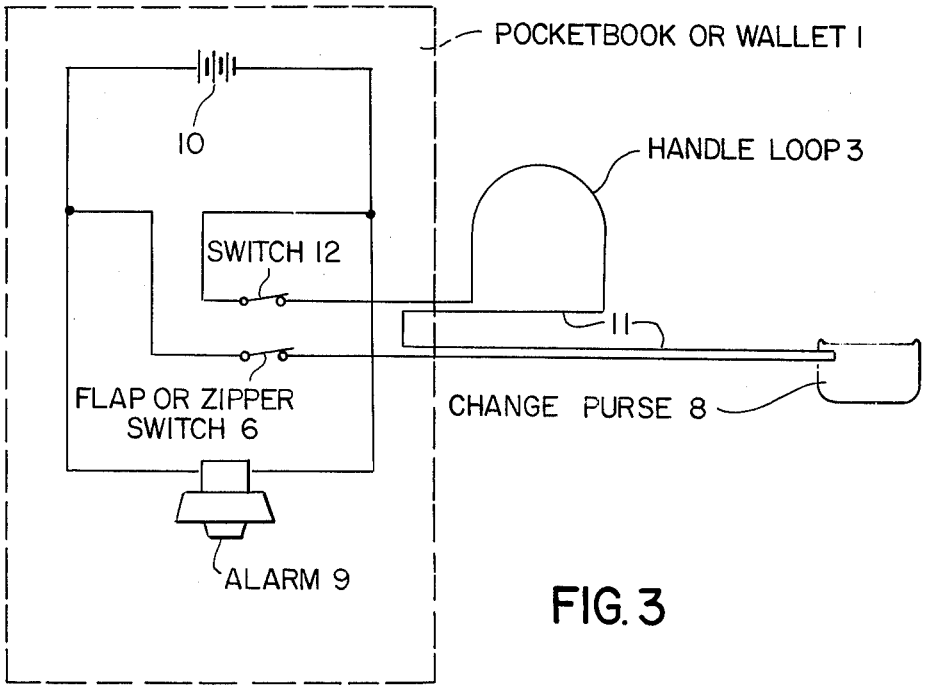
FIG. 3 is a circuit diagram of the handbag alarm system of the invention.

In accordance with the invention, a short-circuiting electrical conductor 11 (FIG. 3) is electrically connected in shunt across the battery 10 and extends through the handle 3 or 4 and the closing device 6 or 7 of the handbag. The closing device 6 or 7 functions as an electrical switch, since electrical current passes therethrough when it is closed and does not pass therethrough when it is open. The short-circuiting conductor 11 short-circuits the battery 10 and prevents energizing of the alarm 9, as shown in FIG. 3. This is due to the fact the current produced by the battery 10 seeks the line of least resistance and thus flows through the short-circuiting conductor 11 rather than the alarm 9, which has a higher electrical resistance.

When the short-circuiting conductor 11 is opened anywhere along its length, it fails to short-circuit the alarm 9 and the alarm is energized. Thus, if anyone cuts the handle 3 or 4 or opens the closing device 6 or 7, the alarm is energized.

The short-circuiting conductor 11 also passes through the change purse 8, as shown in FIG. 3, so that if the change purse is severed from the handbag, the short-circuiting conductor is opened and the alarm 9 is energized.

A normally closed switch 12 (FIGS. 2 and 3) is provided in the handbag and is electrically connected in the short-circuiting conductor 11. Thus, when the switch 12 is operated, it opens the short-circuiting conductor 11 and energizes the alarm 9. This provides the owner of the handbag with a means for selective energization of the alarm.

While the invention has been described by means of a specific example and in a specific embodiment, I do not wish to be limited thereto, for obvious modifications will occur to those skilled in the art without departing from the spirit and scope of the invention.

I claim:

1. A handbag alarm system for a handbag having a handle, an opening, closing means for selectively closing the opening, and a change purse stored in the handbag, said alarm system comprising an audible alarm in the handbag;

battery means in the handbag electrically connected to the alarm for energizing the alarm to produce an audible signal; and a short-circuiting electrical conductor electrically connected in shunt across the battery means and extending through the handle and closing means of the handbag whereby the short-circuiting short-circuits the battery means and prevents energizing of the alarm and when the short-circuiting conductor is opened anywhere along its length it fails to short-circuit the alarm and the alarm is energized.

2. A handbag alarm device as claimed in claim 1, wherein the short-circuiting conductor passes through the change purse so that if the change purse is severed therefrom the short-circuiting conductor is opened and the alarm in energized.

3. A handbag alarm device as claimed in claim 1, further comprising a normally closed switch in the handbag electrically connected in the short-circuiting conductor whereby when the switch is operated it opens the short-circuiting conductor and energizes the alarm.

* * * * *